US007036190B2

(12) United States Patent
Demarest

(10) Patent No.: US 7,036,190 B2
(45) Date of Patent: May 2, 2006

(54) CLOSURE MECHANISM FOR APPAREL

(75) Inventor: Nathan Demarest, Portland, OR (US)

(73) Assignee: Nike, Inc., Beaverton, OR (US)

( * ) Notice: Subject to any disclaimer, the term of this patent is extended or adjusted under 35 U.S.C. 154(b) by 21 days.

(21) Appl. No.: 10/804,369

(22) Filed: Mar. 19, 2004

(65) Prior Publication Data

US 2005/0204517 A1 Sep. 22, 2005

(51) Int. Cl.
*A44B 18/00* (2006.01)

(52) U.S. Cl. ..... 24/401; 24/452; 24/DIG. 38; 2/96

(58) Field of Classification Search ..... 24/452, 24/390, 399, 401, 400, DIG. 38, DIG. 41, 24/306, 415; 2/96, 128, 141.1, 217, 265, 2/912, 913, 915
See application file for complete search history.

(56) References Cited

U.S. PATENT DOCUMENTS

| | | | | | |
|---|---|---|---|---|---|
| 2,077,350 | A * | 4/1937 | Sundback | 24/401 |
| 2,415,643 | A * | 2/1947 | Legat | 24/401 |
| 3,050,842 | A * | 8/1962 | Evans | 24/401 |
| 3,191,255 | A * | 6/1965 | Nealis | 24/401 |
| 3,330,013 | A * | 7/1967 | Morin et al. | 24/401 |
| 3,704,490 | A * | 12/1972 | Hansen | 24/401 |
| 3,772,743 | A * | 11/1973 | Hansen | 24/401 |
| 3,899,805 | A * | 8/1975 | McMillan | 24/DIG. 38 |
| 3,903,572 | A * | 9/1975 | Takagi | 24/401 |
| 4,581,792 | A * | 4/1986 | Spier | 24/DIG. 38 |
| 5,097,570 | A * | 3/1992 | Gershenson | 24/452 |
| 5,396,687 | A * | 3/1995 | Osterman | 24/452 |
| 5,983,467 | A * | 11/1999 | Duffy | 24/452 |

* cited by examiner

*Primary Examiner*—Robert J. Sandy
(74) *Attorney, Agent, or Firm*—Banner & Witcoff, Ltd.

(57) ABSTRACT

A flexible and extensible closure apparatus for use in apparel is disclosed. The flexible and extensible closure apparatus provides continuity to securely join different pieces of material. In addition, a slider apparatus is disclosed to assist a user in joining and separating the flexible and extensible closure apparatus

25 Claims, 11 Drawing Sheets

CLOSURE MECHANISM FOR APPAREL

FIELD OF THE INVENTION

The present invention relates to a closure mechanism for use in apparel. More particularly, the invention concerns a flexible and extensible closure apparatus that provides continuity to securely join fabric type material.

BACKGROUND OF THE INVENTION

Various closure devices have been utilized to join and separate pieces of fabric type material together. Closure devices such as zippers, snaps, and buttons are commonly used in shirts, jackets, pants, skirts, bags, and footwear. These closure devices provide various degrees of continuity between the fabric type materials being joined. For example, a zipper provides better continuity than a button to join two pieces of fabric type material together, as zippers provide continuity along their entire closing path. The use of buttons leaves gaps or openings between the pieces of fabric type material. All of these closure devices, however, are static closure devices that are not flexible and do not allow for expansion or contraction at the connection point or points.

Currently, stretchable fabric type materials are being utilized in more and more apparel designs as stretchable fabrics provide a wearer with a comfortable fit as the material contours to the wearer's body. In particular, stretchable fabrics are commonly used in active wear or sportswear to provide a comfortable fit during sports activity and to prevent skin chaffing that may be caused by loose bunched up clothing.

For example, in cycling highly stretchable fabrics provide a dramatically more comfortable cycling experience. The use of static closure devices in these stretchable fabrics, however, limits the comfort provided by these stretchable fabrics as static closure devices do not allow the entire garment to conform to the cyclist's body. For instance, a zipper used in a highly stretchable cycling garment would not contour to the cyclist's body along with the stretchable fabric. When the cyclist is an upright position the zipper may fit properly and be snug against the cyclist's body. However, when the cyclist is in a bent over position, as when bent over riding, the zipper does not compress or retract causing the zipper to buckle creating a wavy curvature in the zipper and the attached cycling garment.

Though the length of a zipper may be sized to properly fit the cyclist's crunched position, when the cyclist stands upright the static non-flexible zipper becomes a tension point which is uncomfortable for the cyclist and may cause garment tearing. Therefore, there is a need in the art for a flexible and extensible closure apparatus that provides continuity to securely join fabric type material.

SUMMARY OF THE INVENTION

One or more of the above-mentioned needs in the art are satisfied by the flexible and extensible closure apparatus of the present invention. The flexible and extensible closure apparatus provides continuity to securely join and separate material for use in apparel.

In an aspect of the invention, a flexible and extensible closure apparatus comprises a first portion and a second portion. Both the first portion and second portion having inner and outer elements. The elements may be diamond shaped elements. The outer elements may be connected together to form a first continuous strip to which a material may be attached. The inner elements may be connected to the outer elements.

The inner elements of the second portion are longitudinally opposed to the inner elements of the first portion. The inner elements of the first portion may be interconnected with the inner elements of the second portion to form a flush interlocked strip to connect a first section of material to a second section of material.

In another aspect of the invention, a slider apparatus may be utilized to assist a user in joining and separating the flexible and extensible closure apparatus.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The present invention is illustrated by way of example and not limited in the accompanying figures in which like reference numerals indicate similar elements and in which.

DETAILED DESCRIPTION OF THE INVENTION

The following discussion and accompanying figures disclose various aspects of a flexible and extensible closure apparatus that provides continuity to securely join material together for use in apparel.

Figure 1:
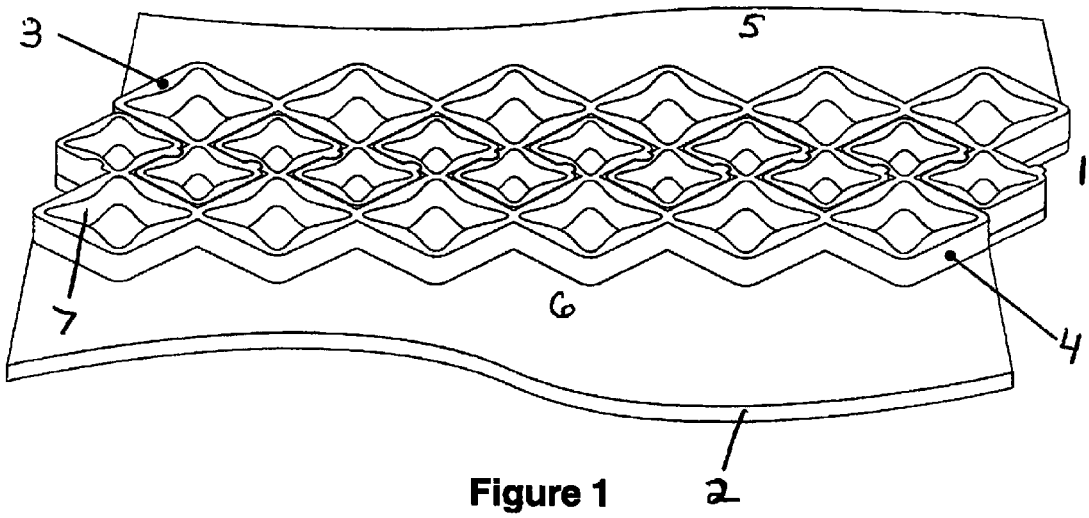
FIG. 1 illustrates an elevational view of a flexible and extensible closure apparatus attached to material to be joined in accordance with the present invention.

Referring to FIG. 1, an elevational view of a flexible and extensible closure apparatus 1 is illustrated in an aspect of the invention. The flexible and extensible closure apparatus 1 may be attached to a material 2 that may represent a portion of a shirt, coat, pants, or other piece of clothing or apparel. The material 2 may be a stretchable fabric to provide a comfortable fit to a wearer of the garment.

The flexible and extensible closure apparatus 1 comprises a first portion 3 and a second portion 4. The first portion 3 and the second portion 4 may form a continuous strip of thermo plastic material when interlocked. Those skilled in the art will realize that the first portion 3 and second portion 4 may be made from other types of flexible plastics, polymers or metals. The first portion 3 and second portion 4 may be mirror images of each other.

The first portion 3 may be attached to a first section 5 of stretchable material while the second portion 4 is attached to second section 6 of stretchable material. The first portion 3 and second portion 4 may be bonded, welded, glued, printed, or thermoformed directly to the first section 5 and second section 6, respectively.

As illustrated in FIG. 1, the first portion 3 and second portion 4 are comprised of elements 7. The elements 7 may be diamond shaped as shown in FIG. 1 or other shapes such as hexagonal, circular, or ovoid shaped. Those skilled in the art will realize that numerous other shapes may be used that fall within the various aspects of the present invention. The diamond shaped elements 7 of the first portion 3 are interlaid with the diamond shaped elements 7 of the second portion 4 forming a continuous strip throughout the length of the flexible and extensible closure apparatus 1.

Figure 1A:
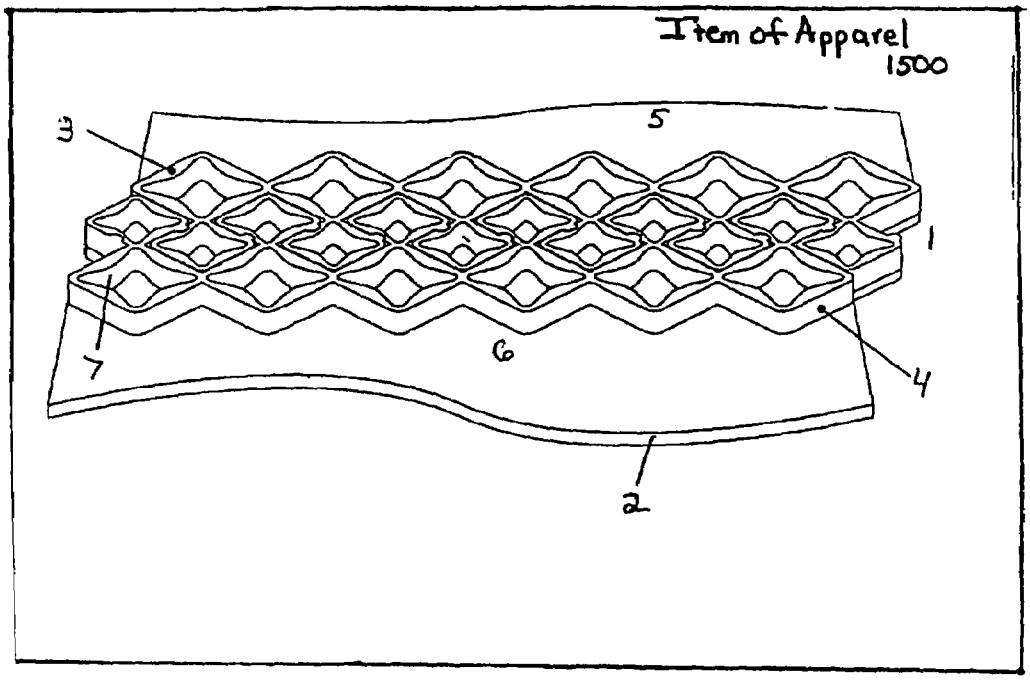
FIG. 1A illustrates an elevational view of a flexible and extensible closure apparatus attached for use in an item of apparel in accordance with the present invention.

In another aspect of the invention, material 2 may or may not have elastic properties. Material 2 may be a fabric type material utilized in apparel items such as shoes or bags. The flexible and extensible closure apparatus 1 for use in a shoe may secure the shoe to a person's foot. For example, the flexible and extensible closure apparatus 1 may be used to connect a first side of a shoe to a second side of the shoe directly over a tongue of the shoe. As illustrated in FIG. 1A, the flexible and extensible closure apparatus 1 may be used in a bag, such as a purse, to provide secure closing of the purse to prevent items from falling out of the purse, or unauthorized removal of items from the purse. In addition, the closure apparatus may be used in other items of apparel 1500 such as shirts, pants, and skirts.

Figure 2:
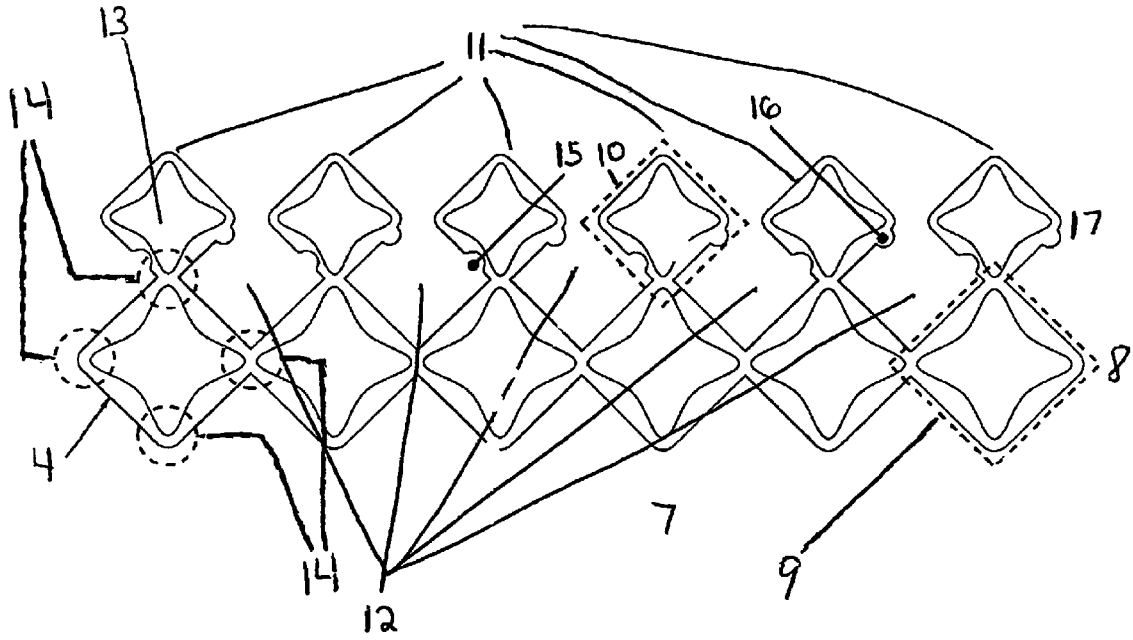
FIG. 2 illustrates a front view of one portion of a flexible and extensible closure apparatus in accordance with the present invention.

In FIG. 2, a front view of one portion of the flexible and extensible closure apparatus 1, such as the second portion 4 of FIG. 1, is illustrated. The second portion 4 may comprise diamond shaped elements 7 of at least two different sizes. As shown in FIG. 2, a first row 8 of larger diamond shaped elements 9 forms a continuous strip the entire length of the flexible and extensible closure apparatus 1. Connected to each of these larger diamond shaped elements 9 are smaller diamond shaped elements 10 as illustrated in a second row 17. The smaller diamond shaped elements 10 are connected to the larger diamond shaped elements 9 forming diamond shaped column pairs 11. The smaller diamond shaped elements 10 of second portion 4 may be interlaid into the opposing first portion 3 (FIG. 3) to form a continuous closure apparatus 1. The interlaying of first portion 3 into second portion 4 or alternatively, the interlaying of second portion 4 into first portion 3 may be possible as the diamond shaped column pairs 11 form openings 12 that may accept the smaller diamond shaped elements 10 from the opposing portion.

FIG. 2 also illustrates that the diamond shaped elements 7 may be hollow 13 allowing greater flexibility of the diamond shaped elements 7. The diamond shaped elements 7 may also be comprised of various wall thicknesses. For example, in a first embodiment, the wall thickness may range from 0.2 millimeters to 1 centimeter. In a second embodiment, the wall thickness may range from 0.5 millimeters to 1 millimeter. Alternatively, the diamond shaped elements 7 may utilize thinner walls at the corners 14 where the diamond shaped elements 7 may be interconnected. The use of thinner walls at the corners of the diamond shaped elements 7 may aid in compression and elongation of individual diamond shaped elements 7.

The hollow diamond shaped elements 7 of the first portion 3 (FIG. 1) when interlocked with the opposing hollow diamond shaped elements 7 of the second portion 4 may allow for extension in length of the entire flexible and extensible closure apparatus 1. The hollow diamond shaped elements 7 may allow a bending along a parallel plane to the surfaces being joined. The deformation in the diamond shaped elements 7 of the first portion 3 may be mimicked by diamond shaped elements 7 of the second portion 4, the first portion 3 and second portion 4 maintaining a flush interface that resists shear stresses when elongated or compressed. The elongation and compression of the flexible and extensible closure apparatus 1 enables the wearer of apparel to feel more comfortable as the closure apparatus may expand and contract. Additionally, the use of the flexible and extensible closure apparatus 1 prevents apparel from tearing or ripping under shear type stresses.

Furthermore, FIG. 2 illustrates that the smaller diamond shaped elements 10 may comprise grooves 15 and notches 16 which may be used to secure the first portion 3 of FIG. 1 to the second portion 4 of FIG. 2. The grooves 15 and notches 16 interconnect with the opposing portion's grooves 15 and notches 16 to prevent movement and separation of first portion 3 and second portion 4 from each other in a direction perpendicular to a plane defined by the second portion 4 shown in FIG. 2.

Figure 3:
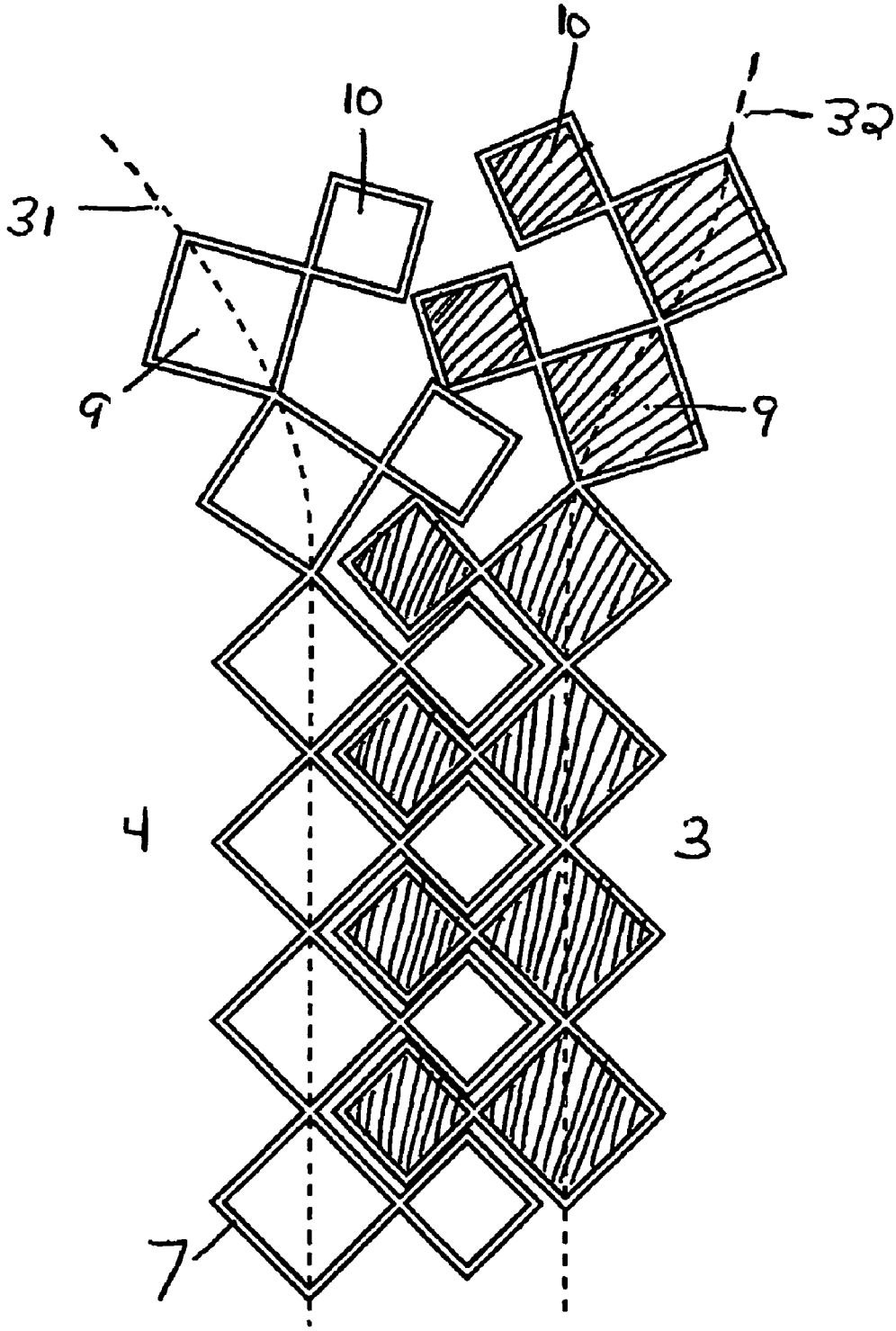
FIG. 3 illustrates a rotated front view of a flexible and extensible closure apparatus in accordance with the present invention.

FIG. 3 illustrates a rotated front view of the flexible and extensible closure apparatus 1. The first portion 3 is shown cross hatched for illustration purposes only. As shown in FIG. 3, both the first portion 3 and second portion 4 may be rotated or twisted apart from each other. This rotation may occur about either of the two axes that are perpendicular to the long axis of the flexible and extensible closure apparatus 1. These axes of rotation include the orthogonal axis to the plane of the closure and the parallel axis to the plane of the closure. The specific rotation of the individual diamond shaped elements 7 in relation to the first portion 3 or second portion 4 creates a temporary gap between diamond shaped elements 7 into which an opposing diamond shaped element may enter. Following rotation, the diamond shaped element that entered is now interlocked with the two opposing elements that originally formed the gap. The interlocking of the diamond shaped elements 7 may be initiated at one end of the second portion 4 and continue along the length of the second portion 4 until the opposite end of second portion 4 is reached. In addition, the interlocking of the first portion 3 and second portion 4 may be terminated at any point along the length of the flexible and extensible closure apparatus 1 and can be initiated at separate ends or multiple points along the length of the flexible and extensible closure apparatus 1. Utilizing a comparable, yet opposite, rotation as that used to join the two sides together will disengage the first portion 3 and second portion 4.

For example, FIG. 3 illustrates that the rows of the second portion 4 may be rotated or twisted in a direction indicated by path 31; whereas, the rows of the first portion 3 may be rotated or twisted in a direction indicated by path 32. By rotating or twisting the rows of the second portion 4 or first portion 3, the smaller diamond shaped elements 10 may be interconnected with the opposing side's diamond shaped elements. Similarly, rotating or twisting the rows of either the second portion 4 or first portion 3 may allow separation of the second portion 4 from the first portion 3.

Figure 4:
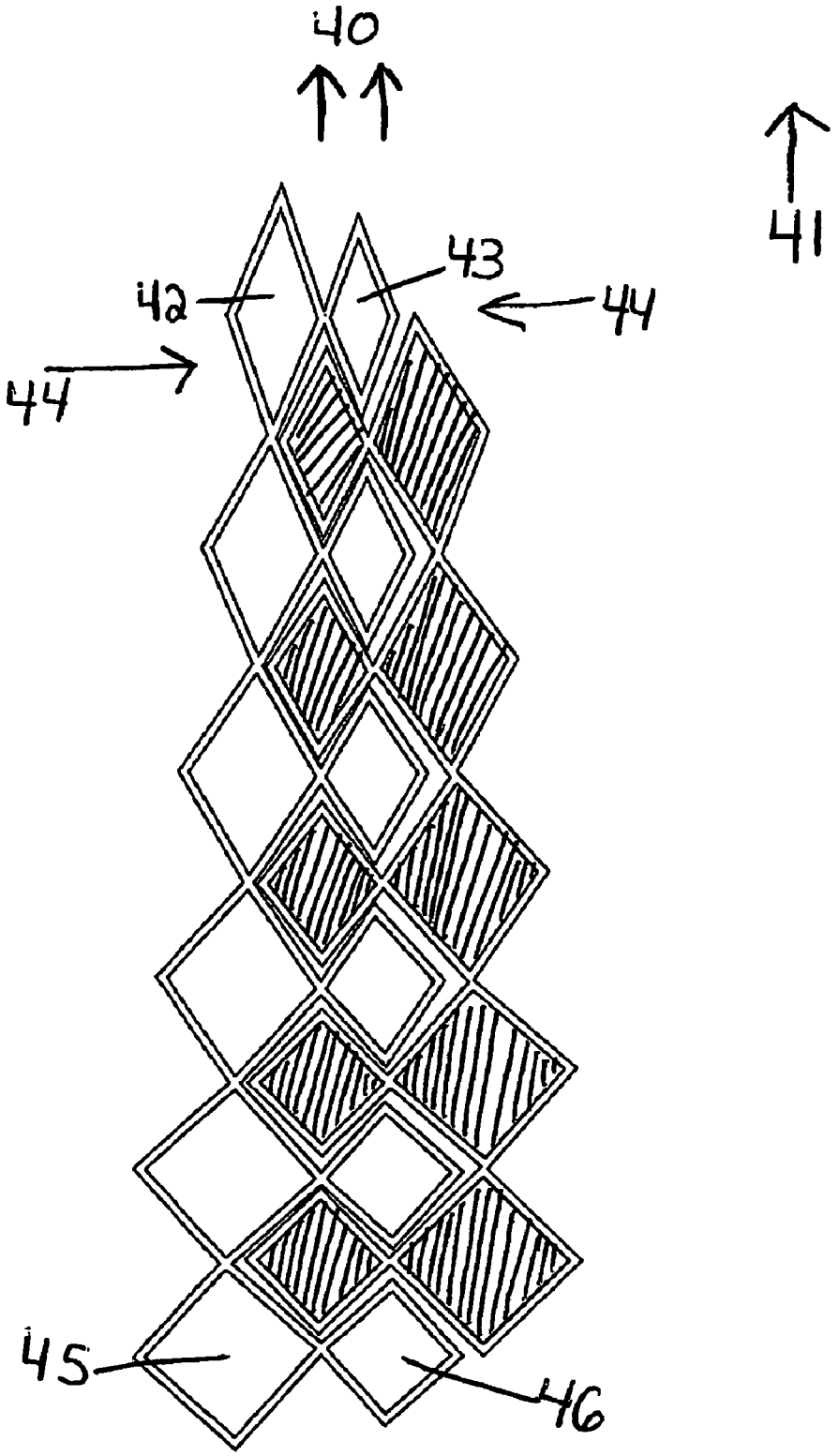
FIG. 4 illustrates an elongated, rotated front view of a flexible and extensible closure apparatus in accordance with the present invention.

FIG. 4 shows an elongated view of the flexible and extensible closure apparatus 1. When a force 40 is asserted on flexible and extensible closure apparatus 1 in a direction 41, the force 40 may tend to cause the diamond shaped elements 7 to compress in a direction perpendicular to the force 40 asserted. For example, a force 40 applied in direction 41 may elongate diamond shaped elements 42 and 43. At the same time, diamond shaped elements 42 and 43 are compressed 44 in a direction perpendicular to the force 40 asserted. Similarly, other diamond shaped elements 7 as shown in FIG. 4 may also be elongated and compressed by the applied force 40. The amount of elongation and compression by the diamond shaped elements 7 may be a function of the amount of force applied and the distance of the force applied to the various diamond shaped elements 7. For instance, diamond shaped elements 45 and 46 may not be elongated and compressed by the same proportions as diamond shaped elements 42 and 43 as force 40 propagates through the flexible and extensible closure apparatus 1.

Figure 5:
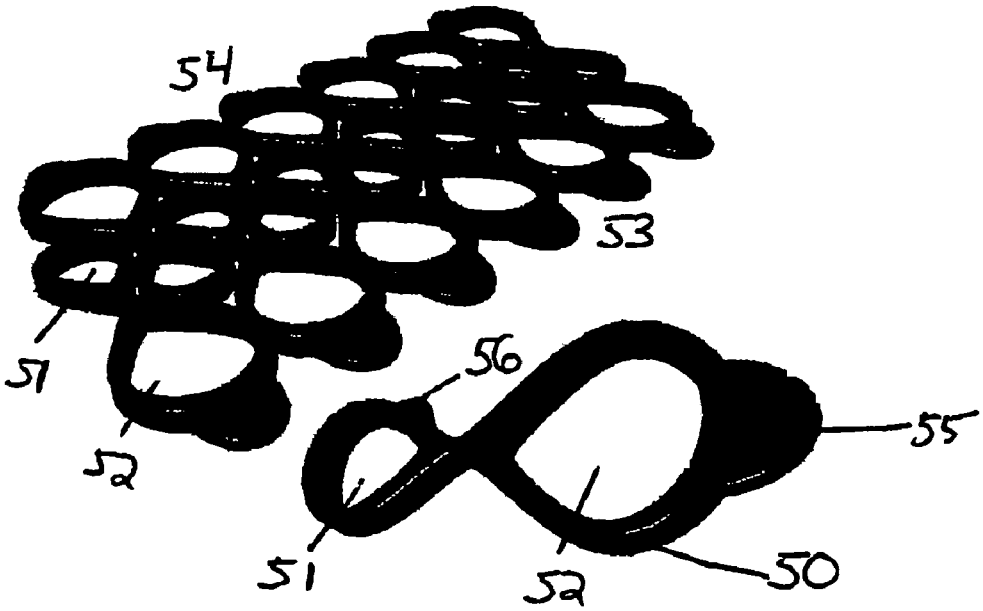
FIG. 5 illustrates an alternative configuration for use in the flexible and extensible closure apparatus in accordance with the present invention.

FIG. 5 illustrates another aspect of the present invention. Referring to FIG. 5, figure-eight shaped elements 50 may be used in the flexible and extensible closure apparatus of the present invention. The figure-eight shaped elements 50 may comprise a smaller ovoid shaped element 51 and larger ovoid shaped element 52. The figure-eight shaped elements 50 may be bonded, welded, glued, printed or thermoformed directly to a fabric type material (not shown) that may have elastic properties. The figure-eight shaped elements 50 are longitudinally opposed along an inner side second portion 54 and first portion 53 for interlocking the second portion 54 to the first portion 53. For both the second portion 54 and first portion 53, the larger ovoid shaped elements 52 are connected to each other to form one side of the closure. Additionally, the larger ovoid shaped elements 52 provide means for transferring the deformation of ovoid shaped elements 52 to one another, and also aid in securing first portion 53 and second portion 54 to a fabric type material (not shown). The larger ovoid shaped elements 52 may also comprise a tab 55 for attaching the fabric type material (not shown) to the figure-eight shaped elements 50.

Figure 6:
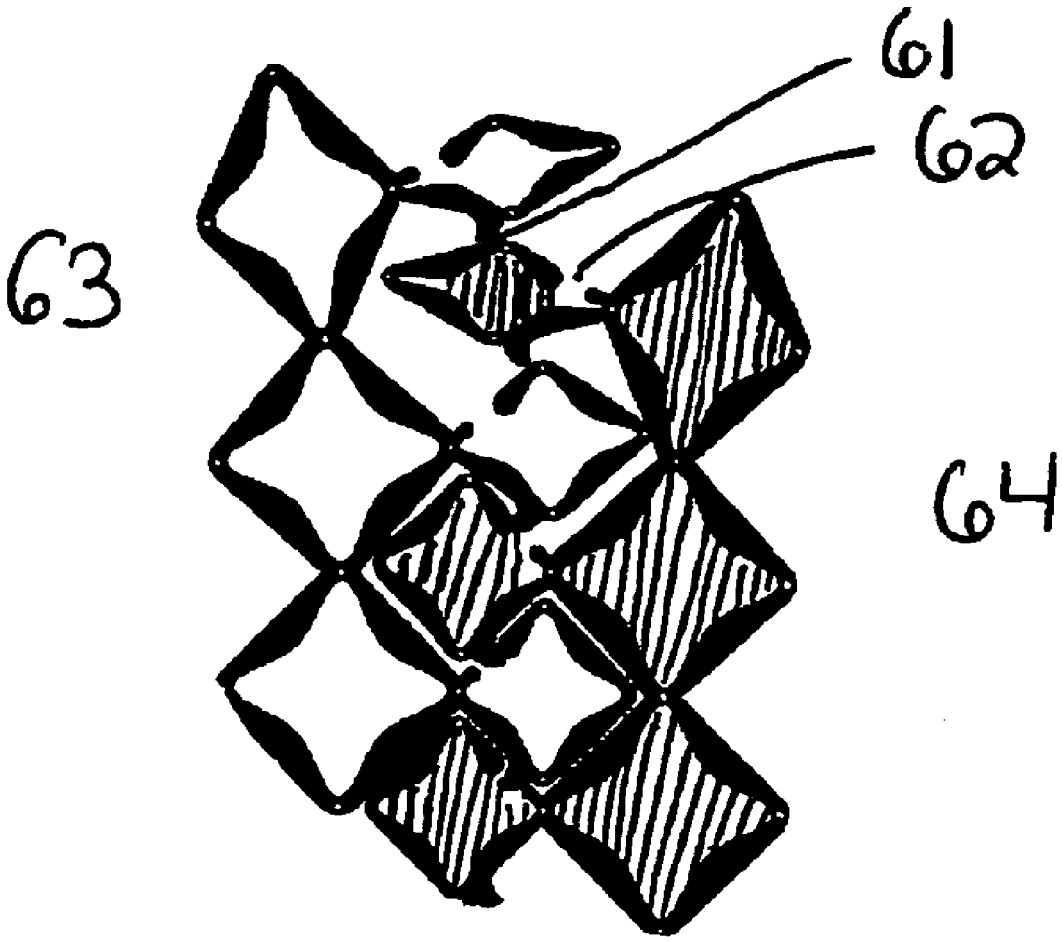
FIG. 6 illustrates another aspect of a flexible and extensible closure apparatus in accordance with the present invention.

Furthermore, FIG. 5 illustrates that the smaller ovoid shaped elements 51 may comprise a notch 56 which will mate with an opposing groove (not shown) to prevent movement and separation of a first portion 53 and a second portion 54 from each other in a direction perpendicular to a plane defined by the interconnected first portion 53 and second portion 54. Similarly, FIG. 6 illustrates that the notch 56 (FIG. 5) may comprise various shapes such as a fin shape 61. The corresponding groove 62 is shaped to accept the fin shape 61. Those skilled in the art will realize that numerous alternative shapes may be utilized to prevent movement and separation of a first portion 63 and a second portion 64 from each other in a direction perpendicular to a plane defined by the interconnected first portion 63 and second portion 64.

Figure 7:
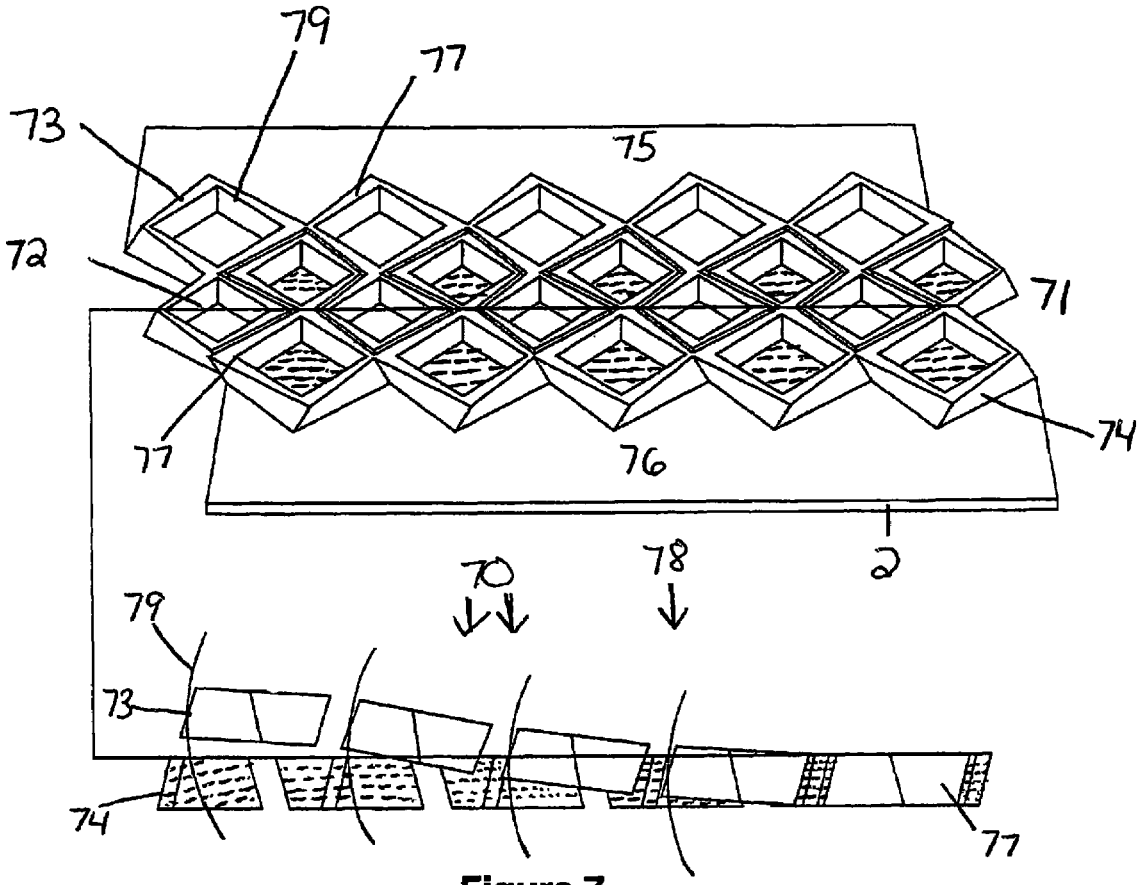
FIG. 7 illustrates an elevational view of a flexible and extensible closure apparatus along with a cross section of the elevational view in accordance with the present invention.

FIG. 7 shows an elevational view along with a cross section view of a flexible and extensible closure apparatus 71 in accordance with another aspect of the invention. As illustrated in FIG. 7, flexible and extensible closure apparatus 71 may be attached to a fabric type material 2 that may represent a portion of a shirt, coat, pants, or other piece of clothing or apparel. The fabric type material 2 may be a stretchable fabric to provide a comfortable fit to a wearer of the garment.

The flexible and extensible closure apparatus 71 comprises a first portion 73 and a second portion 74. The second portion 74 is shown cross hatched for illustration purpose only. The first portion 73 and the second portion 74 may form a continuous strip of thermo plastic material when interlocked. Those skilled in the art will realize that the first portion 73 and second portion 74 may be made from other types of flexible plastics, polymers or metals. The first portion 73 and second portion 74 may be mirror images of each other.

The first portion 73 may be attached to a first section 75 of material while the second portion 74 is attached to second section 76 of material. The first portion 73 and second portion 74 may be bonded, welded, glued, printed, or thermoformed directly to the first section 75 and second section 76, respectively.

As illustrated in FIG. 7, the first portion 73 and second portion 74 are comprised of diamond shaped elements 77. Other shapes such as hexagonal, circular, or ovoid shaped may be utilized. Those skilled in the art will realize that numerous other shapes may be used that fall within the various aspects of the present invention. The diamond shaped elements 77 may be of various sizes such as small diamond shaped elements 72 or large diamond shaped elements 79.

The diamond shaped elements 77 of the first portion 73 are interlaid with the diamond shaped elements 77 of the second portion 74 forming a continuous strip throughout the length of the flexible and extensible closure apparatus 71. The first portion 73 and the second portion 74 may be rotated or twisted apart from each other. This rotation may occur about either of the two axes that are perpendicular to the long axis of the flexible and extensible closure. These axes of rotation include the orthogonal axis to the plane of the closure and the parallel axis to the plane of the closure. The specific rotation of the individual diamond shaped elements 77 in relation to the first portion 73 or second portion 74 creates a temporary gap between diamond shaped elements into which an opposing diamond shaped element may enter. Following rotation the diamond shaped element that entered is now interlocked with the two opposing elements that originally formed the gap. The interlocking of the diamond shaped elements 77 may be initiated at one end of the first portion 73 and continue along the length of the first portion 73 until the opposite end of first portion 73 is reached. In addition, the interlocking of the first portion 73 and second portion 74 may be terminated at any point along the length of the flexible and extensible closure apparatus 71 and can be initiated at separate ends or multiple points along the length of the flexible and extensible closure apparatus 71. Utilizing a comparable, yet opposite, rotation as that used to join the two sides together will disengage the first portion 3 and second portion 4.

For example, the cross sectional view shown in FIG. 7, illustrates that a force 70 may be applied in a direction 78 to the first portion 73. As the force 70 is applied to the first portion 73, the diamond shaped elements 77 from both the first portion 73 and second portion 74 are interlocked together. The interlocked first portion 73 and second portion 74 maintain a flush interface that resists shear stresses when elongated or compressed.

Figure 8:
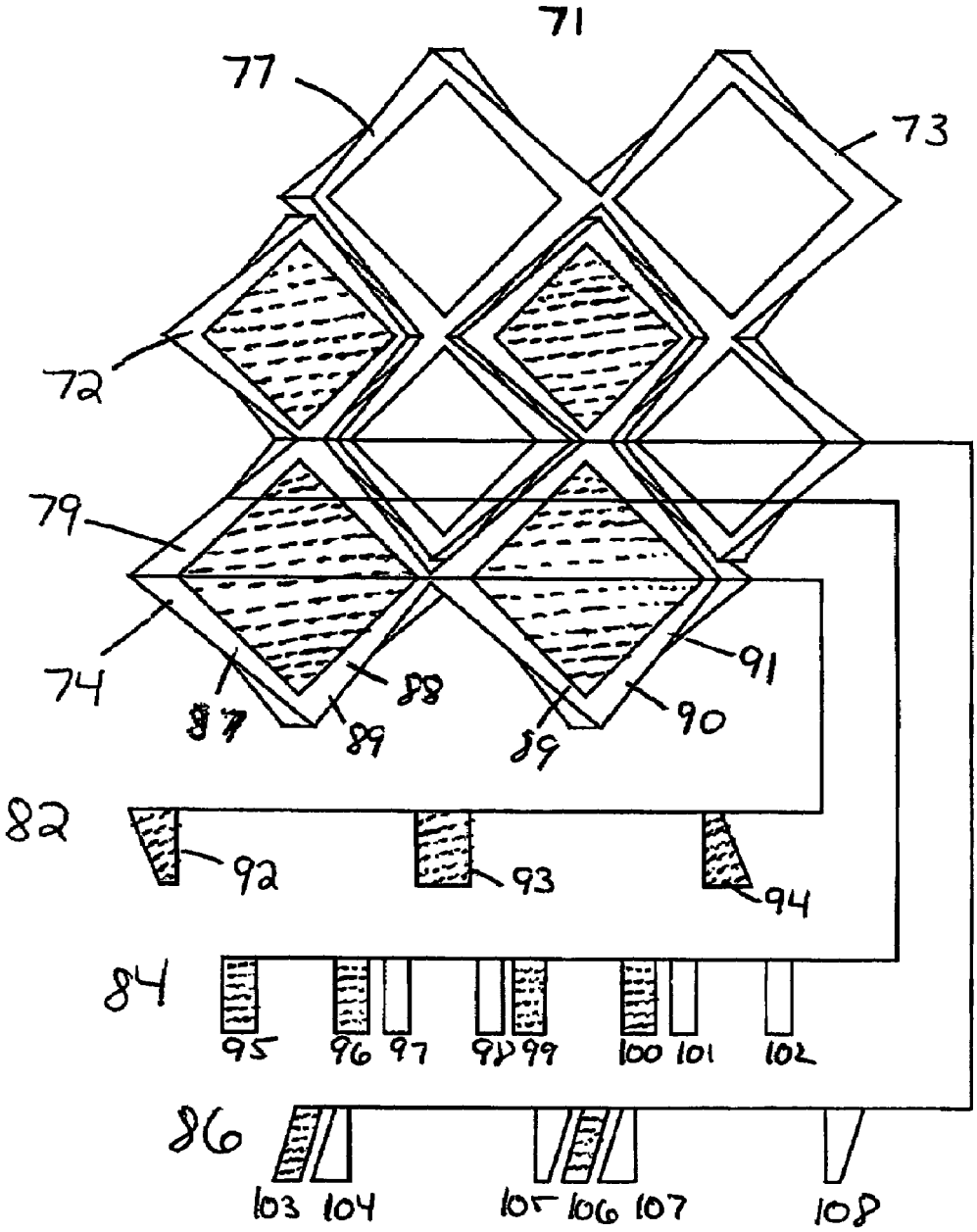
FIG. 8 illustrates a front view of a flexible and extensible closure apparatus along with cross sections of the front view in accordance with the present invention.

FIG. 8 illustrates a front view and multiple cross sectional views of FIG. 7 in accordance with another aspect of the invention. As shown in FIG. 8, flexible and extensible closure apparatus 71 comprises a first portion 73 and a second portion 74. The second portion 74 is shown cross hatched for illustration purposes only. The first portion 73 and the second portion 74 may form a continuous strip of thermo plastic material when interlocked. The diamond shaped elements 77 of the flexible and extensible closure apparatus 71 may have various sloped or angled sides or walls. The sloped or angled walls prevent movement and separation of first portion 73 and second portion 74 from each other in a direction perpendicular to a plane defined by the interconnected first portion 73 and second portion 74 shown in FIG. 8. As one skilled in the art will realize, numerous other slopes or angles other than those illustrated in FIG. 8 may be utilized on the diamond shaped elements 77 and still fall within the scope of the present invention.

For example, cross section 82 shows at least one possible configuration of walls 87 and 88 for diamond shaped element 89. Similarly, cross section 82 shows at least one possible configuration of walls 89 and 90 for diamond shaped element 91. The cross section view for at least wall 87 is shown in cross section view 92. The cross section view for at least walls 88 and 89 is shown in cross section view 93. The cross section view for at least wall 90 is shown in cross section view 94.

Similar to cross section 82, cross section 84 shows cross section views 95 through 102 and cross section 86 shows cross section views 103 through 108. Those skilled in the art will realize that the illustrated cross sections were chosen to illustrate various wall angles and slopes. Various other cross sections may have been chosen to illustrate the angled or sloped walls. Additionally, those skilled in the art will realize that the walls of the diamond shaped elements 77 may be sloped at various angles to prevent movement and separation of a first portion 73 and second portion 74 in a direction perpendicular to a plane defined by both the first portion 73 and second portion 74.

Figure 9:
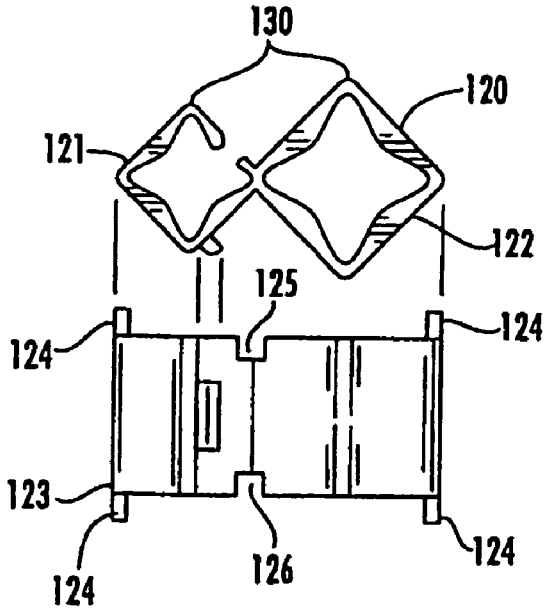
FIG. 9 illustrates a side view of a flexible and extensible closure apparatus in accordance with the present invention.

FIG. 9 illustrates a side view of diamond shaped element 120 in accordance with an aspect of the present invention. As shown in FIG. 9, diamond shaped element 120 may comprise a smaller diamond shaped element 121 and a larger diamond shaped element 122. The smaller diamond shaped element 121 may include a notch 123.

Both the smaller diamond shaped element 121 and the larger diamond shaped element 122 may be hollow allowing greater flexibility of both the smaller diamond shaped element 121 and the larger diamond shaped element 122. In addition, both the smaller diamond shaped element 121 and the larger diamond shaped element 122 may be constructed using various wall thicknesses. For example, in a first embodiment, the wall thickness may range from 0.2 millimeters to 1 centimeter. In a second embodiment, the wall thickness may range from 0.5 millimeters to 1 millimeter. Alternatively, both the smaller diamond shaped element 121 and the larger diamond shaped element 122 may be thin walled at the corners 130. The use of thinner walls at the corners 130 may aid in compression and elongation of individual diamond shaped elements 121 and 122.

Diamond shaped element 120 may comprise cylindrical posts 124 located on a top and a bottom surface of diamond shaped element 120. Additionally, diamond shaped element 120 may also comprise a top slot 125 and a bottom slot 126.

Figure 10:
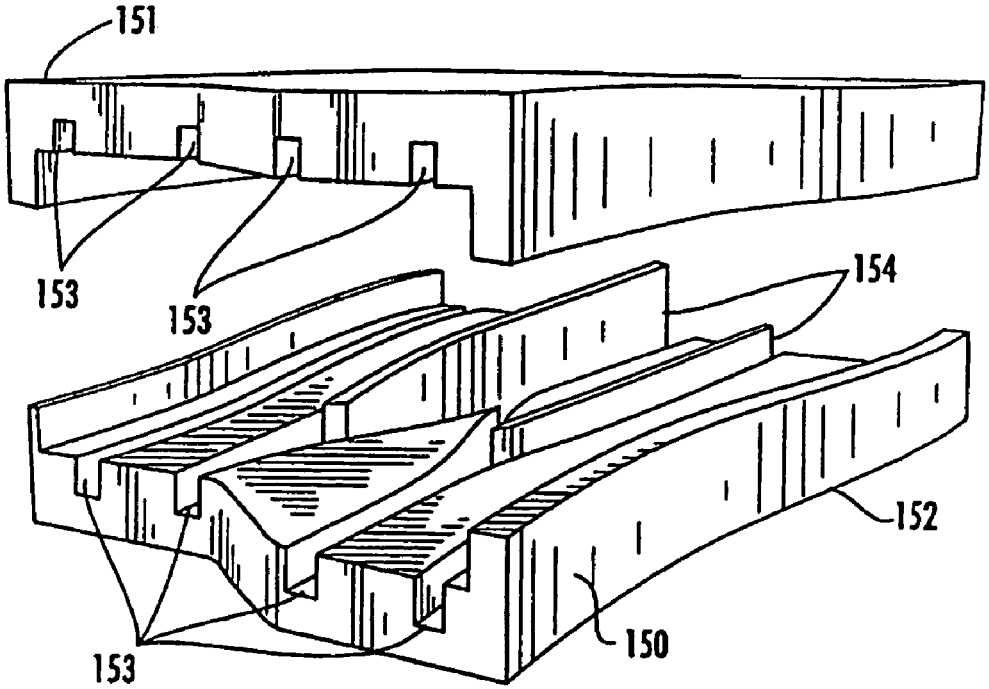
FIG. 10 illustrates a slider apparatus for the flexible and extensible closure apparatus in accordance with the present invention.
Figure 10A:
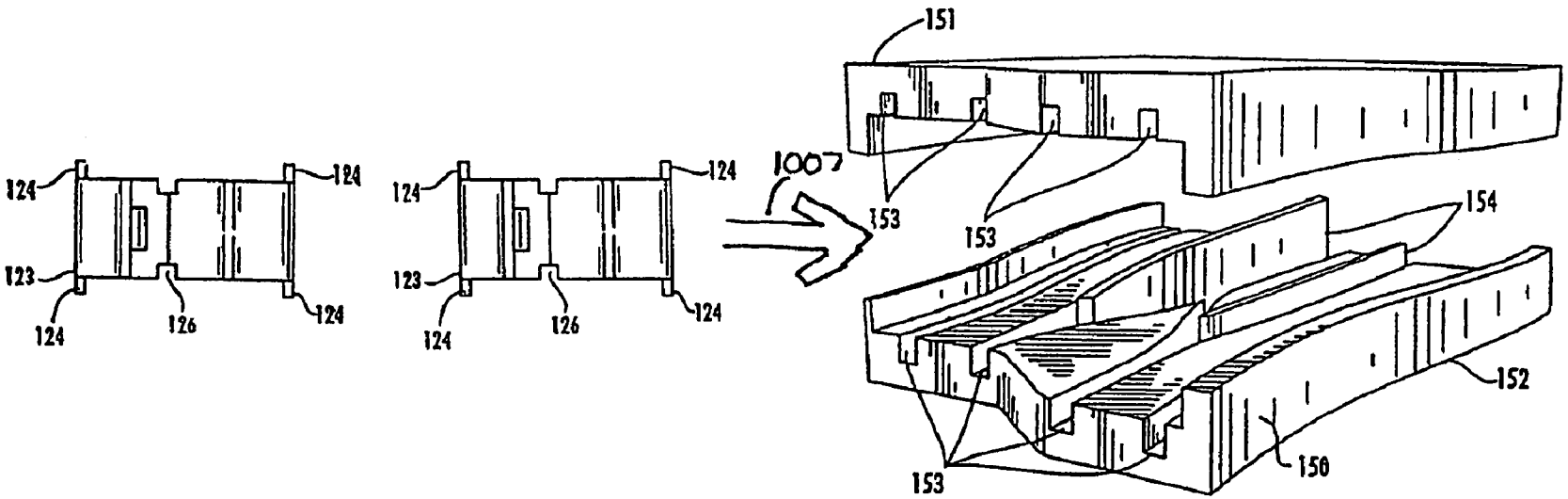
FIG. 10A illustrates another aspect of a slider apparatus for the flexible and extensible closure apparatus in accordance with the present invention.

FIGS. 10 and 10A illustrates a slider apparatus 150 that may assist a user in interlocking or separating a first portion 3 (FIG. 1) and a second portion 4 (FIG. 1) of the flexible and extensible closure apparatus 1. As shown in FIG. 10, a slider apparatus 150 may comprise a top plate 151 and a bottom plate 152. The top plate 151 and bottom plate 152 may contain slots 153. The slots 153 may be positioned to receive the cylindrical posts 124 of the diamond shaped element 120 (FIG. 9). As further illustrated in FIG. 10, slider apparatus 150 may also comprise rails such as bottom rails 154 and top rails (not shown). These rails may be positioned to allow the top slot 125 and bottom slot 126 to ride along a bottom rail 154 and a top rail (not shown). The top plate 151 of the slider apparatus 150 may slide along a top surface of both first portion 3 and second portion 4 of the flexible and extensible closure apparatus. Similarly, the bottom plate 152 of the slider apparatus may slide along a bottom surface of both the top surface 3 and the second portion 4 of the flexible and extensible closure apparatus 1. As top plate 151 and bottom plate 152 slide along the first portion 3 and second portion 4 of the flexible and extensible closure apparatus 1, the diamond shaped elements are interlocked. For example, FIG. 10A illustrates the insertion of diamond shaped elements 120 of FIG. 9 into the slider apparatus to join at least the inner elements of both the diamond shaped elements 120. The diamond shaped elements 120 are inserted into the slider apparatus as shown by arrow 1007 of FIG. 10A. The interlocking of the diamond shaped elements may be initiated at one end of the second portion 4 and continue along the length of the second portion 4 until the opposite end of second portion 4 is reached. In addition, the interlocking of the first portion 3 and second portion 4 may be terminated at any point along the length of the flexible and extensible closure apparatus 1 and can be initiated at separate ends or multiple points along the length of the flexible and extensible closure apparatus 1.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

I claim:

1. A flexible and extensible closure apparatus for use in apparel, comprising:

a first portion having inner elements and outer elements, the outer elements connected together to form a first continuous strip, the outer elements attached to a first section of material, each of the inner elements connected to at least one of the outer elements; and a second portion having inner elements and outer elements, the outer elements of the second portion connected together to form a second continuous strip, the outer elements attached to a second section of material, each of the inner elements connected to at least one of the outer elements of the second portion, the inner and outer elements of the second portion longitudinally opposed to the inner and outer elements of the first portion, the inner and outer elements of the first portion interconnected with the inner and outer elements of the second portion to form an interlocked strip to join the first section of material to the second section of material wherein the hollow inner elements of the first and second portions and the hollow outer elements of the first and second portions comprise hollow diamond shaped elements.

2. The flexible and extensible closure apparatus of claim 1 wherein the hollow inner diamond shaped elements of the first and second portions and the hollow outer diamond shaped elements of the first and second portions comprise different sized hollow diamond shaped elements.

3. The flexible and extensible closure apparatus of claim 1 wherein the hollow inner elements of the first and second portions and the hollow outer elements of the first and second portions comprise hollow ovoid shaped elements and, wherein the hollow inner ovoid shaped elements of the first and second portions and the hollow outer ovoid shaped elements of the first and second portions comprise different sized hollow ovoid shaped elements.

4. The flexible and extensible closure apparatus of claim 1, wherein the first section of material and the second section of material comprise a stretchable fabric type material.

5. The flexible and extensible closure apparatus of claim 1, wherein the apparel is selected from the group consisting of shirts, pants, skirts, shoes, and bags.

6. The flexible and extensible closure apparatus of claim 1, wherein the interlocked strip is separable into the inner and outer elements of the first portion and the second portion in order to partition the first section of material from the second section of material.

7. A flexible and extensible closure apparatus for use in apparel, the flexible and extensible closure apparatus comprising:

a first size element;

a second size element;

a first portion including:

a first row of connected first size elements, the connected first size elements forming a first continuous strip, the first continuous strip attached to a first section of material; and a second row of second size elements, each of the second size elements connected to one of the first size elements;

a second portion including:

a third row of connected first sized elements, the connected first size elements of the second portion forming a second continuous strip, the second continuous strip attached to a second section of material; and a fourth row of second size elements, each of the second size elements of the second portion connected to one of the first size elements wherein the first size elements of each of the first portion and the second portion and the second size elements of each of the first portion and the second portion comprise first size hollow diamond shaped elements and second size hollow diamond shaped elements; and wherein the fourth row of second size elements is interlayed with the first row of first size elements and the second row of second size elements to form a flush interlocked strip to join the first section of material to the second section of material.

8. The flexible and extensible closure apparatus of claim 7, wherein the first section of material and the second section of material comprise a stretchable fabric type material.

9. The flexible and extensible closure apparatus of claim 7, wherein the apparel is selected from the group consisting of shirts, pants, skirts, shoes, and bags.

10. The flexible and extensible closure apparatus of claim 7, wherein the fourth row of second sized elements is separated from the first row of first size elements and the second row of second size elements, the first section of material being separated from the second section of material.

11. The flexible and extensible closure apparatus of claim 7, wherein the second row of second size elements is interlayed with the third row of first size elements and the fourth row of second size elements to form a flush interlocked strip to connect the first section of material to the second section of material.

12. The flexible and extensible closure apparatus of claim 11, wherein the second row of second sized elements is separated from the third row of first size elements and the fourth row of second size elements, the first section of material being separated from the second section of material.

13. A flexible and extensible closure apparatus for use in apparel, comprising:

a first portion having inner hollow elements and outer hollow elements, the outer elements connected together to form a first continuous strip, the outer elements attached to a first section of material, each of the inner elements connected to at least one of the outer elements of the second portion; and a second portion having inner hollow elements and outer hollow elements, the outer elements of the second portion connected together to form a second continuous strip, the outer elements attached to a second section of material, each of the inner elements of the second portion connected to at least one of the outer elements of the second portion, the inner elements of the second portion longitudinally opposed to the inner elements of the first portion, wherein the hollow inner elements of each of the first and second portions and the hollow outer elements of each of the first and second portions comprise hollow diamond shaped elements; and a slider, the slider joining the inner elements of the first portion with the inner elements of the second portion to form an interlocked strip to join the first section of material to the second section of material.

14. The flexible and extensible closure apparatus of claim 13, wherein the hollow inner diamond shaped elements of the first and second portions and the hollow outer diamond shaped elements of the first and second portions comprise different sized hollow diamond shaped elements.

15. The flexible and extensible closure apparatus of claim 13, wherein the hollow inner elements of the first and second portions and the hollow outer elements of the first and second portions comprise hollow ovoid shaped elements.

16. The flexible and extensible closure apparatus of claim 15, wherein the hollow inner ovoid shaped elements of the first and second portions and the hollow outer ovoid shaped elements of the first and second portions comprise different sized hollow ovoid shaped elements.

17. The flexible and extensible closure apparatus of claim 13, wherein the first section of material and the second section of material comprise a stretchable fabric type material.

18. The flexible and extensible closure apparatus of claim 13, wherein the apparel is selected from the group consisting of shirts, pants, skirts, shoes, and bags.

19. The flexible and extensible closure apparatus of claim 13, wherein the interlocked strip is separable into the inner and outer elements of the second portion and the inner and outer elements of the first portion in order to partition the first section of material from the second section of material.

20. An item of apparel comprising:

a first section of material;

a second section of material; and a closure apparatus for joining the first section of material to the second section of material, the closure apparatus comprising:

a first portion having inner elements and outer elements, the outer elements connected together to form a first continuous strip, the outer elements attached to the first section of material, each of the inner elements connected to at least one of the outer elements; and a second portion having inner elements and outer elements, the outer elements of the second portion connected together to form a second continuous strip, wherein the inner elements of each of the first and second portions and the outer elements of each of the first and second portions comprise hollow diamond shaped elements, the outer elements attached to the second section of material, each of the inner elements of the second portion connected to at least one of the outer elements of the second portion, the inner and outer elements of the second portion opposed to the inner and outer elements of the first portion, the inner and outer elements of the first portion interconnected with the inner and outer elements of the second portion to form an interlocked strip.

21. The item of apparel of claim 20, wherein the hollow inner diamond shaped elements of the first and second portions and the hollow outer diamond shaped elements of the first and second portions include walls of varying thickness to assist in compression and elongation of the hollow inner diamond shaped elements and the hollow outer diamond shaped elements, the walls being interconnected to form corners of both the inner and outer diamond shaped elements of each of the first and second portions.

22. The item of apparel of claim 20, wherein the first section of material and the second section of material comprise a stretchable fabric type material.

23. The item of apparel of claim 20, wherein the item of apparel is selected from the group consisting of shirts, pants, skirts, shoes, and bags.

24. The item of apparel of claim 20, wherein the interlocked strip is separable into the inner and outer elements of the first portion and the second portion in order to partition the first section of material from the second section of material.

25. The item of apparel of claim 20, wherein the interlocked strip is partially separable into the inner and outer elements of the first portion and the second portion in order to partition the first section of material from the second section of material.

* * * * *